US005535932A

United States Patent [19]

Ruczienski

[11] Patent Number: 5,535,932

[45] Date of Patent: Jul. 16, 1996

[54] METHOD AND APPARATUS FOR SEVERING BANDING STRAPS

[76] Inventor: Erwin R. Ruczienski, 17425 Stephens, East Pointe, Mich. 48021

[21] Appl. No.: 316,645

[22] Filed: Sep. 30, 1994

[51] Int. Cl.[6] ..... B26B 27/00

[52] U.S. Cl. ..... 225/1; 30/165; 225/93

[58] Field of Search ..... 29/564.3; 30/165, 30/347, 355; 225/91, 1, 93; 81/177.85; 83/13

[56] References Cited

U.S. PATENT DOCUMENTS

| | | | |
|---|---|---|---|
| 717,735 | 1/1903 | Coffin | 30/165 |
| 888,495 | 5/1908 | Hayward | 30/165 |
| 927,653 | 7/1909 | Heckman . | |
| 991,525 | 5/1911 | McGreevey . | |
| 1,044,551 | 11/1912 | Lynch . | |
| 1,173,026 | 2/1916 | Petermann . | |
| 1,372,531 | 3/1921 | Mitchell . | |
| 2,593,663 | 4/1952 | Fanelli | 30/165 |
| 2,711,109 | 6/1955 | Gillstrom | 30/165 |
| 2,719,358 | 10/1955 | Lassen | 30/165 |
| 3,211,189 | 10/1965 | Wheeler . | |
| 3,348,524 | 10/1967 | Butler | 225/91 |
| 3,473,578 | 10/1969 | McArdle et al. . | |
| 3,599,328 | 8/1971 | Ursetta | 30/128 |
| 3,629,883 | 12/1971 | Norman | 7/1 R |
| 3,713,200 | 1/1973 | Burns . | |
| 3,791,031 | 2/1974 | Brothers et al. | 30/296.1 |
| 3,835,489 | 9/1974 | Lagace et al. . | |
| 4,195,401 | 4/1980 | Galloup . | |
| 4,195,760 | 4/1980 | Bos . | |
| 4,199,833 | 4/1980 | Sitkins et al. | 7/166 |
| 4,416,059 | 11/1983 | Humphrey et al. . | |
| 4,907,660 | 3/1990 | Staggs et al. | 81/177.85 |
| 5,403,230 | 4/1995 | Capriglione, Sr. | 30/355 |

*Primary Examiner*—Kenneth E. Peterson
*Attorney, Agent, or Firm*—Barnes, Kisselle, Raisch, Choate, Whittemore & Hulbert

[57] ABSTRACT

A band severing method and tool having a band severing head made entirely in one piece from a unitary high strength body of metal. The body of the head has a continuous slot formed transversely therethrough and open at the laterally opposite ends thereof and at an end opening whereby the tool body can be receivingly engaged with a band run by entry of the band run edgewise through the slot. Slot band engaging edges on the head body are oriented at a convergent taper angle in the direction to the body axis and have a plurality of band run engaging teeth arranged in a serrated tooth pattern therealong. With the band run held so engaged with a portion of the run trapped in the body slot, the slot edges impart a band severing rupture in the band run at its engagement along the passageway slot edges transversely of the band in response to application of torque to the head operable to cause bodily rotation of the head body in one continuous direction of rotation. A partial body-entwined wrapping action is thereby applied to the band run. The band run is held restrained exteriorly of the head to resist the tension stresses imparted to the band by such partial wrapping action, and a complete rupture of the band run is effected during such continuous unidirectional bodily rotation in less than one revolution of the head.

22 Claims, 4 Drawing Sheets

METHOD AND APPARATUS FOR SEVERING BANDING STRAPS

FIELD OF THE INVENTION

This invention relates generally to cutting tools and methods, and more particularly to improvements in methods and apparatus for severing metal strap banding used to encircle and secure bulk packages.

BACKGROUND OF THE INVENTION

It is common in the packaging and shipping industry to utilize banding straps of various forms as a package tie, either directly around the plurality of the articles to be shipped to securely retain them as a unit, or around the container in which the articles are placed. For example, in the packaging and shipping of heavy bulk packages, such as a coil of cold rolled steel, large crates or cartons as commonly used in industrial and commercial packaging, steel band straps are commonly employed which are wrapped about the stack of the articles, or about the package in which the articles are placed, utilizing a special banding tool adapted to tension the band during the wrapping process so that the same tightly encircles the shipment. The ends of the band strap are then permanently interconnected using various type of permanent fasting devices. Such banding straps are provided in various widths and thicknesses, depending upon the weight, size and type of packaging application and provide a very reliable means of securing the articles and/or package containing the same against breakage, rupture, pilferage and rough handling.

Because the tensioned bands are secured at their ends by various types of non-releasable permanent fastening implements, in order to open the band-wrapped bulk package to provide access to the packaged articles, it is necessary to sever each continuous encircling loop of the banding to thereby destructively remove it from the package, the severed the band then being discarded as scrap. Inasmuch as steel banding for heavy packages typically constitutes strip stock ranging in width from one-half inch to one and one-half inches and in thickness from 0.035 inches to 0.050 inches, special hand operated cutting tools have customarily been provided for the purpose of cutting the banding strips to unpackage the load. Typically these hand tools constitute an industrial type, and grade of scissors which embody force multiplication mechanisms to handle the heavy duty cutting involved. Such band cutting hand tools are relatively expensive and in many cases awkward to operate in particular packaging locations and band orientations where access is difficult. Moreover, because of their scissors-cutting action, such conventional tools require the cutting edges to be made sharp and so maintained in use, thereby necessitating resharpening or replacement at relatively frequent intervals, and also that safety precautions be observed by the user.

OBJECTS OF THE INVENTION

Accordingly, objects of the present invention are to provide an improved method of severing banding straps, and an improved hand tool for performing the method, which is simple, quick and inexpensive to perform and wherein the tool construction is simple, inexpensive and requires no relatively moving parts, can sever heavy duty steel banding and the like rapidly and efficiently, is safe in use and requires no sharp edges, has a long service life and is not easily damaged, and which can be readily provided in various embodiments to suit particular applications involved in severing package banding as well as other related severing operations involving tensioned strip-like members, such as chain link fencing wire, metal sheeting, etc.

BRIEF DESCRIPTION OF DRAWING FIGURES

Other objects, features and advantages of the present invention will become apparent from the following detailed description, appended claims and accompanying drawings (which are to scale unless otherwise indicated) illustrating various embodiments and modifications of the invention, wherein:

FIG. 1 is a perspective view looking downwardly on a coil of strip steel secured by metal band strapping and illustrating the initial application of one embodiment of an improved band severing tool of the present invention as used in performing the method of the invention, the tool being shown initially engaged with one loop of the band strapping and ready for the initiation of a band severing stroke of the tool;

DETAILED DESCRIPTION OF PREFERRED EMBODIMENTS

Figure 1:
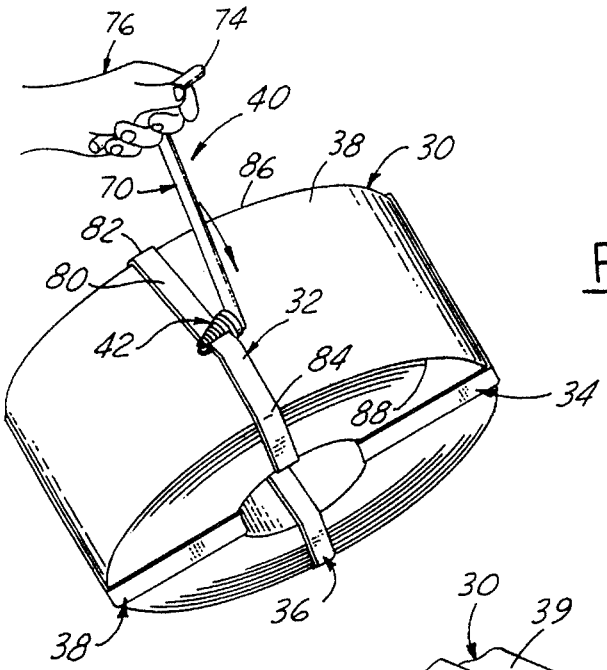

Referring in more detail to the accompanying drawings, FIG. 1 illustrates, by way of example, a heavy bulk package 30 consisting of a typical coil of cold rolled sheet metal strip material as conventionally packaged for shipment by four loops 32, 34, 36 and 38 of heavy gauge flexible steel banding. Each band loop 32–38 is applied by conventional commercial banding apparatus which draws the steel band tight after being arranged in a loop about each associated segment of the coil 30. Each such loop is securely and permanently fastened by a clinch-type fastener of conventional construction (not shown). When coil 30 is received by the user the loops of banding straps 32–38 must be severed in order to remove the straps from coil 30 to place it in use, the cut straps 32–38 then being discarded as scrap. Hitherto this has customarily been done with a scissors-type heavy duty cutting tool by inserting the lower of its blades one at a time between each of the straps 32–38 and the outer surface 39 of the outside coil turn, and then operating the cutting tool with a scissors-like snipping action.

Figure 10:
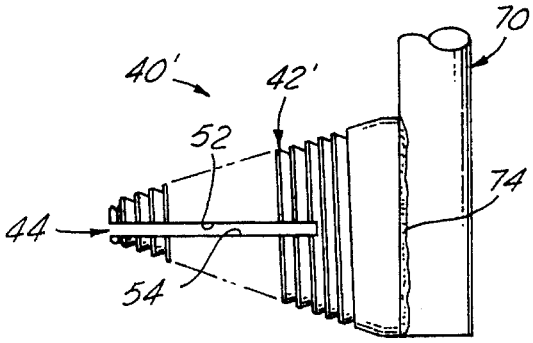
FIG. 10 is a side elevational view of the tool head shown in FIG. 9.
Figure 11:
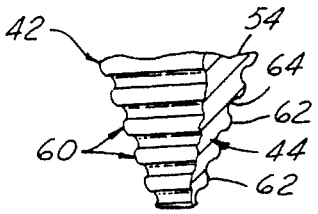
FIG. 11 is a fragmentary plan view of a portion of the tool head illustrating the type of tooth-forming groove turned on the head of FIGS. 1–6 and with a portion broken away to illustrate the slot-edge tooth profile in the plane of the slot lower surface.

However, and in accordance with the present invention as shown in the embodiment of FIGS. 1–6 and 11, an improved band severing tool 40 is provided to accomplish the severing of each of the banding strips 32–38 in a faster, more efficient and reliable manner in accordance with the improved band-severing method of the invention. Tool 40 generally comprises a cutting or severing head 42 which preferably is in the form of a conical solid metal body having a blind end cross slot 44 formed therein. Slot 44 extends transversely straight across the body, preferably coincident with its center line axis C/L (FIG. 4), and is open at each side and at the narrow nose end 46 of head 42. Slot 44 terminates at a rear wall 48 spaced approximately three quarters of the distance between nose 46 and a cylindrical maximum diameter rear barrel portion 50 of head 42. Slot 44 is thus a blind slot of uniform gap height across the slot, i.e., the distance perpendicularly between its interior opposed flat faces 52 and 54 (FIG. 10). This slot gap dimension is suitably sized to receive with a sliding clearance the maximum thickness banding strap normally encountered in the range of band severing applications intended for the tool. For example, the slot gap height may be approximately 0.100 inches to accommodate the maximum thickness dimension of most industrial steel banding straps currently in use. Likewise, the overall axial dimension of head 42 need be made only long enough such that slot 44 can be made deep enough (slot length axially of head 42) to fully encompass a maximum banding strap width of say 1.50 inches.

In the first embodiment of head 42 of FIGS. 1–6 the outer peripheral surface of the conically shaped portion of head 42 has a helical thread 60 lathed-turned therein. Preferably, this is done prior to formation of slot 44 in head 42, following which slot 44 may be cut in head 42 by a suitably milling or grinding tool to thereby interrupt thread 60 along each of the opposed flat surfaces 52 and 54 defining slot 44. This automatically forms rounded teeth 62 (FIG. 11) alternating with grooves 64 in a row along each laterally opposite edge of each of the slots surfaces 52 and 54. Preferably thread 60 has a round-type form to provide a smoothly radiused thread so that each tooth 62 and its adjacent root groove 64 blend together with the equal radii of curvature. To enhance slidability of head 42 between strap 32 and coil surface 39, a pair of diametrically opposed flat surfaces 66 and 68 are formed in the threaded periphery as by flat grinding off the peaks of thread 60 with a flat grinding wheel (see FIGS. 5 and 6 as well as FIGS. 2–4).

Figure 9:
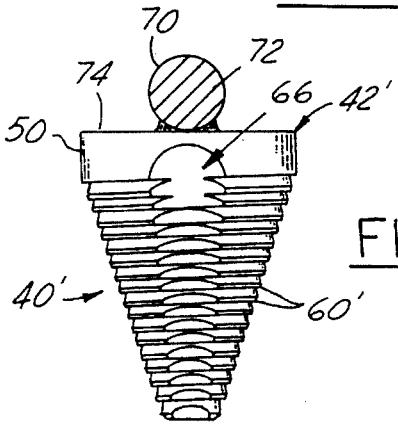
FIG. 9 is a plan view of a slightly modified embodiment of the band severing tool of the invention, with the tool handle being shown in cross-section and embodying a modified buttress thread turned on the head periphery to form the teeth along the band-engaging slot of the tool head.

Tool 40 of the embodiment of FIGS. 1–6 (as well as the slightly modified tool 40 of FIGS. 9 and 10) is provided with a permanently affixed operating handle 70 made by welding a cylindrical rod 72 to the flat rear face 74 of head 42 (as best seen in FIGS. 9 and 10) such that rod 72 is oriented with its axis perpendicular to the center axis C/L of head 42 and extends therefrom a suitable crank arm distance, such as 12 inches. The free end of rod 70 remote from head 42 carries a cross rod 74 (FIG. 1) welded at its center to the remote free end of rod 72. Rod 74 may for example, be about 4 inches in length. Operating handle 70 thus is in the form of a T-bar to facilitate gripping of tool 70 by one hand 76 for manipulation of the tool in its operation by the user, as shown in FIG. 1.

Figure 2:
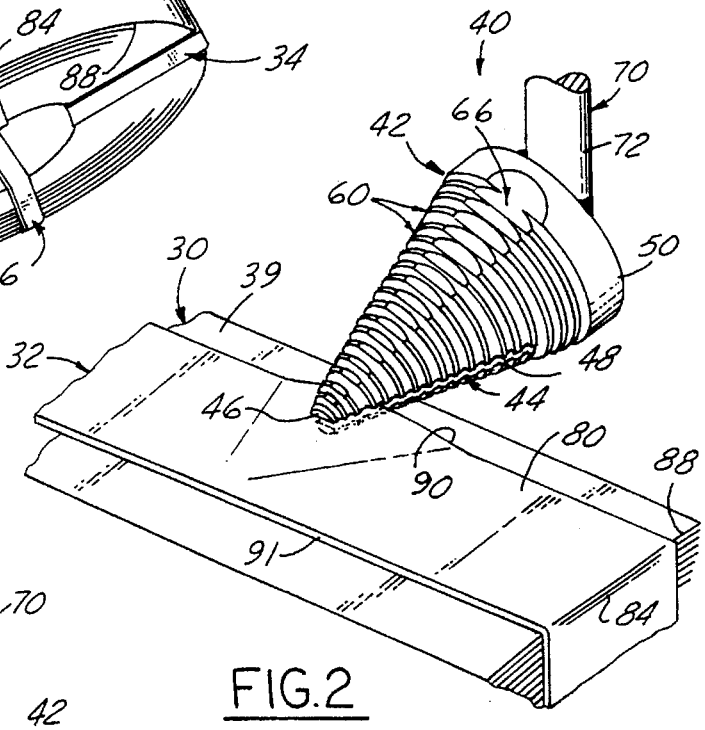
FIG. 2 is a fragmentary perspective view of the embodiment of the tool of FIG. 1 illustrated enlarged thereover, and as it is initially being slipped beneath the banding strap while receiving one edge of the strap, as slightly raised by the tool, within a cross slot of the tool head.

To cut metal strap banding which encircles a bulk package, such as the coil 30 of steel strip stock, the user of tool 40 grips tool T-handle 70 as shown in FIG. 1 and manipulates tool 40 so as to insert head 40 nose-end-first into transverse engagement with a run 80 of strap 32 about midway between the opposite edges 82 and 84 of run 80 where the same is bent perpendicularly around the side edges 86 and 88 of coil 30. Initially the mouth of slot 44 at head nose 46 is aligned with the facing edge 90 of strap run 80, with the lower flat surface 68 of head 42 resting slidably on the outer surface 39 of coil 30. Hence head 40 is thereby tilted to incline its axis C/L from the plane of coil surface 38 so that the strap edge 90 can be readily fed into the mouth of slot 44, as illustrated in FIG. 2. Although strap 32 is typically bound under heavy tension to coil 30, usually there will be a slight gap between the underside of strap run 80 and the adjacent coil surface 39 to permit such initial head insertion into strap engagement for feeding strap edge 90 into the mouth of slot 44. However, if this gap is too small the same may be readily enlarged by prying run 80 upwardly with a screw driver, chisel or the like. Nevertheless this is seldom necessary due to the fine entry angle and thin lips provided by the converging junction of head flat 68 with head nose 46.

Figure 3:
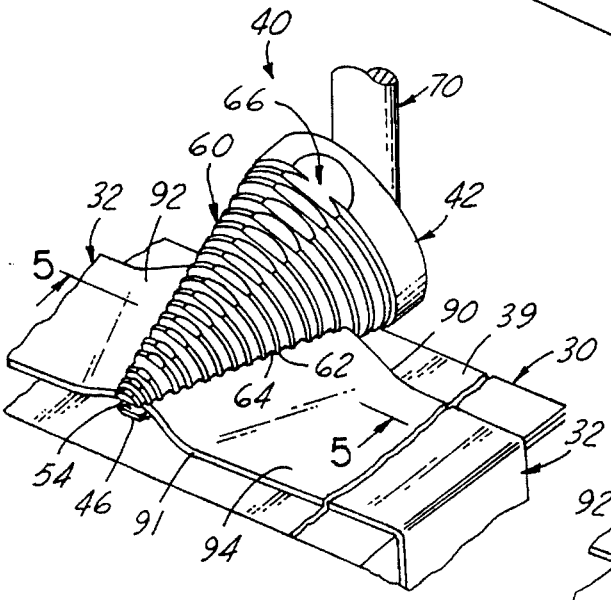
FIG. 3 is a fragmentary perspective view similar to FIG. 2 but illustrating the tool head inserted to a fully band-engaged position with an engaged portion of the banding strap trapped within the head slot.

Once tool 40 is initially strap-engaged as illustrated in FIG. 2, tool head 42 is then further force slidably as a wedge in the direction of the head axis C/L transversely across strap run 80 while handle rod 70 is held upright with its axis in a plane perpendicular to coil surface 39 to further feed strap run 80 into head cross slot 44, i.e., movement of head 42 from the nip position of FIG. 2 toward the fully engaged position shown in FIG. 3. Because of the conical form of head 42 and its narrow pointed end 46, the lower half of head 42 is easily started into the nip position of FIG. 2 with its nose lower half between band run 80 and coil surface 38, despite the tension on band 32 resulting from the banding operation tending to resist run 80 being lifted away from coil surface 38. Then the wedge angle defined between under surface 54 of slot 44 and the lower head flat 68 provides a force multiplying wedging action against the under surface of band run 80 to readily lift it away from coil surface 38, thereby tilting strap run 80 upwardly away from coil surface 39 as head 42 is inserted across strap run 80. This wedge insertion action thus also places the band strap 32 under further tension.

Figure 4:
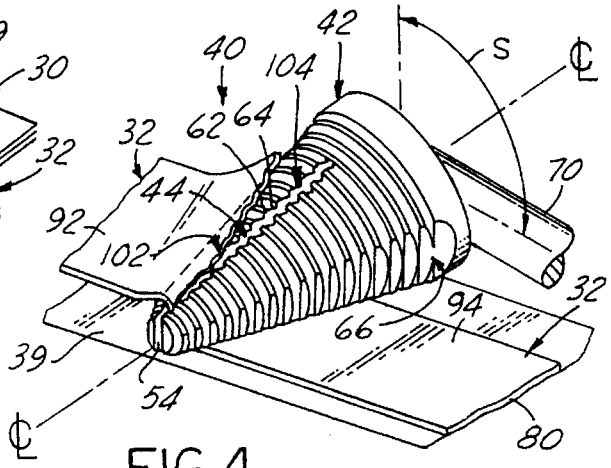
FIG. 4 is a perspective view similar to that of FIGS. 2 and 3 but with the tool head rotated 90° from the position of FIG. 3 to the completion of a band severing stroke, and also illustrating the tool-engaged band fully severed at the completion of the band severing stroke.

Once tool 40 is thus fully engaged with band strap 32 as shown in FIG. 3, in order to completely sever strap 32 the user merely rotates tool head 42 about its center line axis C/L by swinging handle 70 from the upright position shown in FIGS. 1 and 3 through an arc S (FIG. 4) of about 90° to the end-of-stroke position shown in FIG. 4.

Figure 5:
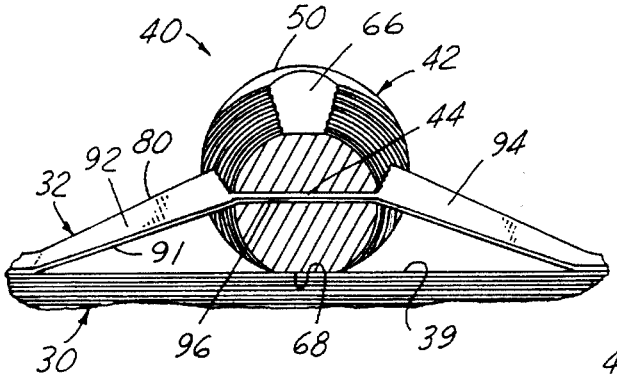
FIG. 5 is an end elevational of the tool as positioned in FIG. 3 with the band fully engaged in the tool head slot, the tool head being shown in section on the line 5—5 of FIG. 3.
Figure 6:
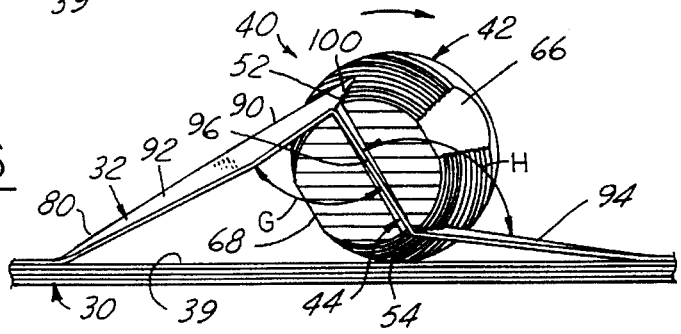
FIG. 6 is a view similar to FIG. 5 but illustrating the tool head rotated approximately 45° from the position of FIG. 3, i.e., halfway between the positions of FIGS. 3 and 4 on the band-severing stroke of the tool.

As better seen in FIGS. 5 and 6, during this quarter-turn of cutting head 42, and while the same is slidably bearing against the coil surface 39, the engaged run 80 of band 32 is further tensioned by the run-wrapping action occurring as the oppositely extending free strap run portions 92 and 94 of run 80 are pulled toward one another due to the head-engaged-portion 96 of run 80 being trapped within the cross slot 44 of head 42. This wrap-tensioning can be seen by comparing FIGS. 5 and 6. As head 42 is so rotated, run portion 94 is forced downwardly toward coil surface 39 as run portion 92 is raised upwardly away from the surface. As explained in more detail hereinafter, this foreshortening of strap run 80 by this "wrapping" action, while run 80 is restrained against such foreshortening at bends 82 and 84 by the remainder of the loop of strap 32, greately increases the tension stress forces and stress level in strap run 80.

Due to the taper angle "T" (see FIG. 21 and related discussion hereinafter) of slot 44, as well as the inclination axis C/L of head 42 relative to its reaction bearing support on coil surface 39, the greatest tension stress exerted by tool 40 on coil strap 32 occurs near the rear blind end of slot 44. Hence, in the example illustrated in FIGS. 5 and 6, the slot teeth 62 along slot surface 54 engaging the undersurface of strap run portion 92 initiate a severing and tear-apart action on run 80 of strap loop 32 at the bend junction of the slot-trapped run portion 96 with upwardly raised free run portion 92. Edge 90 of run portion 92 thus starts separating at this bend line from trapped portion 96 as indicated at initially tear 100 in FIG. 6. It has been observed that this tearing action, once initiated during head rotation, then progresses rapidly, moving along the line of teeth 62 engaging run portion 92 at the associated engaged edges of slot face 54, toward the narrow tip end 46 of head 42 until band strap 32 is completely severed as shown in FIG. 4. It also has been found that this stretch-tearing cutting action of tool 40 generally begins about mid-way in the swing of the tool handle 70 through arc S and such band severing is completed before the tool swinging action has been completed as shown in FIG. 4. Hence tool 40 provides a rapid band cutting action across the entire band width to thereby completely sever the band in less than the one-quarter turn of head 42 imparted by the swing work stroke of the tool handle 70. Due to the long moment arm between T-bar 74 and the rotational axis C/L of head 42, further force multiplication is provided which enables the operator to swing tool through its cutting stroke with a minimum of manual effort even though the tool is completely severing a relatively wide and heavy gauge strip of banding steel.

Figure 7:
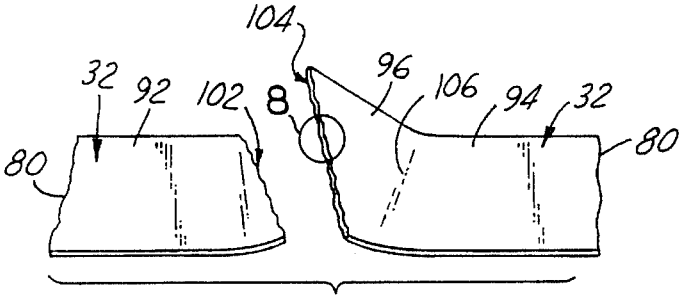
FIG. 7 is a fragmentary perspective view of the band shown by itself after being severed by the tool in the severing operation illustrated in FIGS. 3–6.
Figure 8:
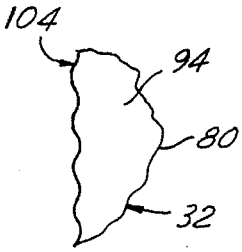
FIG. 8 is a greatly enlarged fragmentary plan view of the portion of the severed edge of the band shown in the circle 8 of FIG. 7.

As shown in FIGS. 7 and 8, the coil banding strap 32 so severed in accordance with the invention is characterized by a diagonal cut line defined by spaced apart severed edges 102 and 104 running generally in a straight line diagonally of strap run 80. As best seen in the enlarged view of FIG. 8, each severed edge 102, 104 is serrated in plan view following the penetration path of the row of slot teeth 62 and grooves 64 running along the severing edge of slot surface 54. Also, as shown in FIG. 7 the portion 96 of strap run 80 trapped within slot 44 during the severing action remains bent upwardly along a bend line 106 where it joins the free portion 94 of run 80 which remained clear of head 42. With coil band 32 thus severed the same can readily be manually removed and freed from coil 30 and discarded as scrap. Tool 40 is then successively engaged with the exposed runs of the remaining coil strap bands 34, 36 and 38 to likewise individually sever the same in one easy swinging stroke of tool 40 for each band to thereby completely unpackage steel coil 30.

FIGS. 9, 10 and 12–20 further illustrate how the novel principles of the severing method of the invention, as well as various features of the novel severing tool 40 of the invention for performing this method, may be varied without departing from the principles of the invention.

FIGS. 9 and 10 illustrate a tool head 42' identical to tool head 42 except for a change in the form of the external thread 60' cut on the conical peripheral surface of the tool. Thread 60' is buttress-type thread suitable turned on the periphery, as by a CNC turret-lathe-type automatic tool operation so that the slot teeth formed at the junction of slot surfaces 52 and 54 with this thread profile have a configuration corresponding to the buttress thread profile at this perpendicular intersection.

Figure 12:
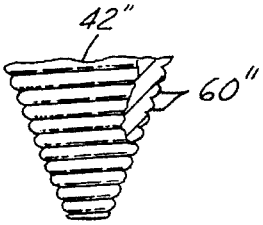
FIG. 12 is a fragmentary plan view similar to FIG. 11 but showing another modified form of tooth-forming thread turned on a tool head of the type shown in FIGS. 1–6.

Likewise, FIG. 12 illustrates how another type of thread having flat top teeth 60" may provide this form of slot edge teeth on a tool head 42" otherwise identical to head 42.

Figure 13:
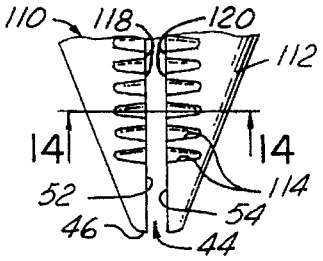
FIG. 13 is a fragmentary plan view illustrating still another type of groove formation in a tool head of the type shown in FIGS. 1–6 to thereby mill or grind form the slot edge teeth in a modified embodiment.
Figure 14:
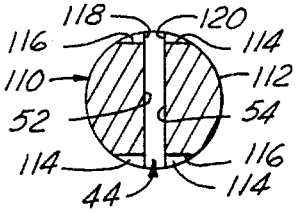
FIG. 14 is a cross-sectional view taken on the line 14—14 of FIG. 13.

FIGS. 13 and 14 further illustrate another embodiment of a tool head 110 also identical to head 42 except for the manner of finishing the outer periphery of the conical portion of the head. Head 110 is made with a smooth conical outer peripheral surface 112 extending axially from the cylindrical shoulder surface (not shown) to the nose 46 of the head. Then a row of interrupted cross slots 114 are formed in surface 112 with the slot roots 116 (FIG. 14) perpendicular to the flat surfaces 52 and 54 of head slot 44. Each row of cross slots 114 is provided diametrically opposite one another on head 110. Cross slots 114 are spaced at equal increments axially of head 110 and preferably are formed by tangentially feeding an end mill or grinding wheel across head slot 44 so as to be of equal chordal root depth in head surface 112. Each row of cross slots 114 thereby forms complimentarily profiled tooth forms 118 and 120 at the intersection of cross slots 114 with slot surfaces 52 and 54 respectively. With this type of slot-formed teeth on head 110 the periphery 112 of head 110 in those portions spaced 90° from head slot 44 remain smooth to facilitate the wedge-like sliding entry action of the head as manipulated into and between the positions thereof of FIGS. 2 and 3, as well as facilitating the sliding rotary action of the head during the swing stroke of the tool between the positions of FIGS. 3 and 4. Cross slots 114 also lend themselves to economical high volume mass production of head 110 since each slot row may be simultaneously formed with one pass of a gang mill or form grinder for each side of head 110. Also, head slot 44 may be formed in head 110 either prior to or after the cross slot forming operation with equal facility.

Figure 15:
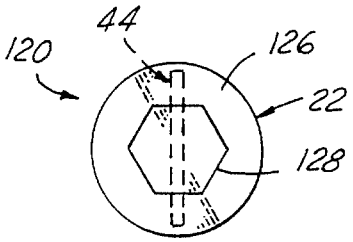
FIG. 15 is a top plan view of a further modified form of tool in which the tool head is made without a permanently attached handle, and is adapted for removable engagement by a socket and associated standard socket wrench to impart rotary operational motion to the tool.
Figure 16:
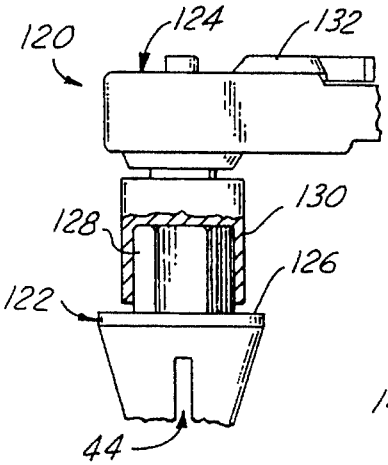
FIG. 16 is a fragmentary side elevational view of the tool head of FIG. 15 illustrating a standard socket and associated socket wrench engaged therewith.

FIGS. 15 and 16 illustrate a still further modified band severing tool 120 of the invention in which the band severing head 122 is made as a separate unitary piece and adapted for operable detachable coupling to an associated crank handle 124 (FIG. 16) Head 122 is provided with the band engaging slot 44 of the previously described head embodiments 42, 42', 42" and 110, has a similarly shaped conically tapering periphery and may have any of the aforementioned slot edge tooth forms of these embodiments. However the flat rear face 126 of head 122 has an integral rotator lug 128 protruding axially therefrom of suitable shape (e.g., hexagonal) and dimension to receive slidably thereon a conventional hex socket 130 coupled to a conventional socket wrench driver 124 in turn provided with the usual pawl and ratchet reversing mechanism 132. Thus tool 120 is rendered operable in the same manner as tool 40 by the detachable engagement thereto of a standard socket 130 and socket wrench 124 which are then used in place of handle 70 of tool 40 to impart the swing stroke to head 122. Head 122 of tool 120 thus can be made and sold as a separate compact item in various head sizes and load ratings. If desired head 122 can be economically provided in sets of heads each having a rotator lug head 128 made in the standard range of sizes for conventional commercially available socket wrench sets which are customarily already on-hand at the facilities of the user. The cost to the user of the two-piece tool 120 may thus be substantially reduced.

In addition, by providing heads 122 as a separate item from their wrench handle, a set of heads may be efficiently used for unpackaging a multiply-banded package. For example, a plurality of heads 122 may be individually driven into engagement with separately accessible banding straps, either by hand force or supplemented by striking head 128 with a hammer or the like in those instances where the banding straps are very tight against their associated package surface. Then the operator so inserting such heads into the band straps may be followed by another band breaking operator using a single socket wrench to sequentially individually engage the inserted heads and then rotate the same to break each of the band straps seriatum, thereby further reducing tooling and labor costs in those unbanding operations and applications lending themself to this approach.

Figure 17:
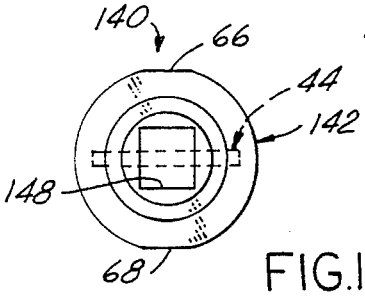
FIG. 17 is a top plan view of yet another embodiment of a tool head made, like that of FIGS. 15–16, without a handle affixed thereto, but adapted for operation by removable engagement with the male coupling driver lug of a standard socket wrench.
Figure 18:
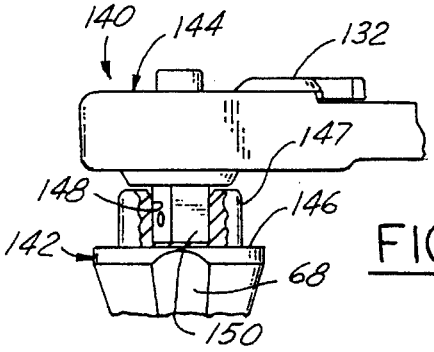
FIG. 18 is a fragmentary side elevational view of the tool head shown in FIG. 17 illustrating the driver lug and associated standard socket wrench removably engaged with the tool head for rotational operation thereof.

FIGS. 17 and 18 illustrate another type of two-piece band severing and actuating tool 140, similar to the separable two-part tool 120, where again the band cutting head 142 is provided separately from a detachable crank arm 144 of tool 140. Head 142 may be constructed similar to head 122 with the band engaging cross slot 4, external thread 60 and opposed flats 66 and 68 or the other periphery and slot tooth forms described previously and arranged in like manner in the conically shaped portion of head 142. However, head 142, like head 122, has an integral rotator lug 147 protruding axially from the rear flat face 146 of the head. Lug 147 is provided with a square socket 148 for receiving the square male coupling lug 150 of a standard socket wrench driver 144. Wrench 144 may again have the standard pawl and ratchet reversing mechanism 132 incorporated therein in accordance with conventional practice. The head 142 of two-part tool 140 thus may be provided as a separate component or in sets in a variety of head sizes and shapes, like the head 122 of tool 120, but the socket 148 of all such heads 142 may be kept standardized to receive the standard half inch square lug 150 of the wrench driver 144 provided in most commercially available socket wrench sets.

Figure 19:
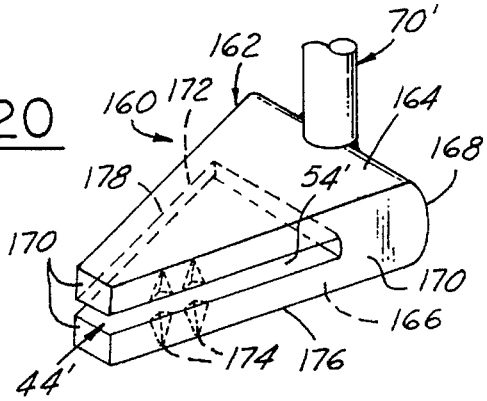
FIG. 19 is a fragmentary perspective view of a still another modified band severing tool also in accordance with the present invention.

FIG. 19 illustrates a further modified form of band severing tool 160 also provided in accordance with the present invention. Tool 160 comprises a band severing head 162 having a generally flat wedge shape to which is affixed an operating handle 70' similar to handle 70. Head 160 may be made from a block of flat tool steel having parallel opposed flat top and bottom faces 164 and 166 respectively and having a rounded or flat rear edge face 168 laterally opposed to a front edge face 170. Head 162 has two side faces 170 and 172 which intersect the front and rear edge surfaces 170 and 168 and which are oriented perpendicular to top and bottom surfaces 164 and 166. Side faces 170 and 172 converge towards front edge face 170 at a taper angle T (see FIG. 21) which may be same as that employed in the previous severing heads 42, 42', 42", 110.

Head 162 is bifurcated by a band receiving slot 44' ground or machined in head 162 with its opposed interior faces 52", 54" parallel to top and bottom head surfaces 164 and 166. Slot edge teeth may be provided in head 162 by grinding grooves 174 in side faces 170 and 172, as indicated by the broken lines in FIG. 19, either before or after formation of the band receiving slot 44'. Grooves 174 are shown with curved roots as they might be made by a circular grinding wheel, but may likewise be made to have their roots extend straight along faces 170 and 172 at a uniform depth by end milling or the like.

Tool 162 thus may be manufactured very economically with a simple machining set up in conventional tooling. If desired, head 162 of tool 160 may be provided as a separate component and the socket wrench coupling systems of the embodiments of FIGS. 15–16 or FIGS. 17–18 provided on head 162 as a substitute for the permanently affixed handle 70'.

Tool 160 may be operated in a manner similar to tool 40 for severing a band held suitably taught for the severing operation as described previously. When tool 160 is utilized in the manner of tool 40 as illustrated in FIGS. 1–6 a lower edge 176 of head 162 defined at the junction of side face 170 and bottom face 166 will operate as a pivot point against the package support surface 39 when head 162 is rotated in the manner of head 42. The slot tooth formation 178 at the junction of lower slot face 54' and head side face 172 will operate in the manner of the similar oriented tooth formation of head 42 to assist in the tear-severing of the band strap.

Figure 20:
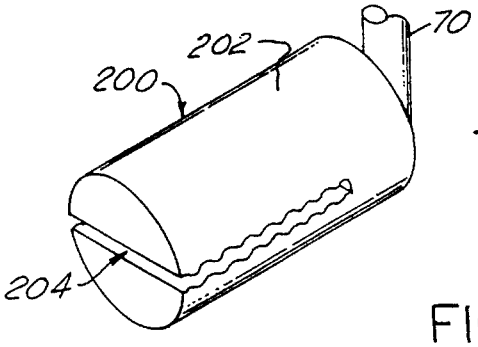
FIG. 20 is a fragmentary perspective view of an experimental tool head provided for comparative purposes.
Figure 21:
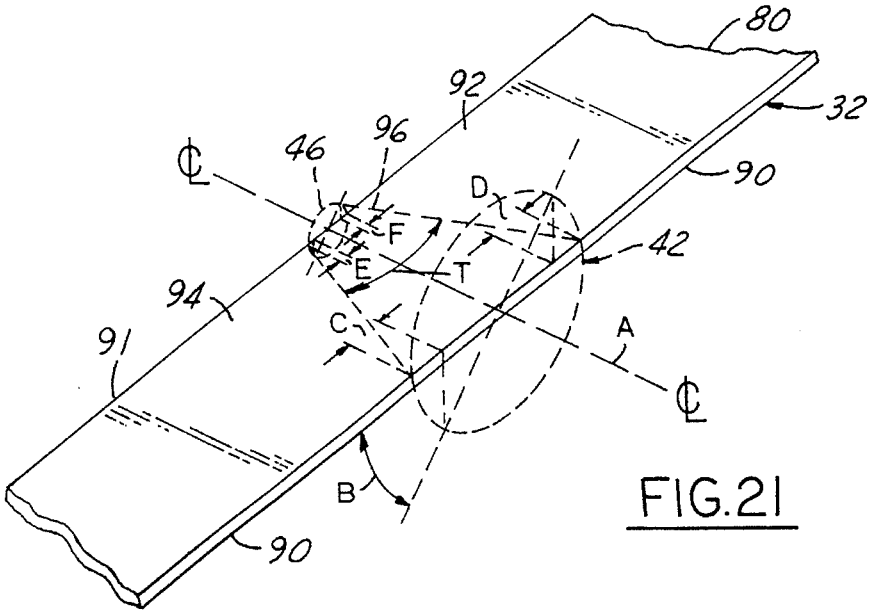
FIG. 21 is a fragmentary diagrammatic perspective view illustrating certain principles of the band-severing method of invention and the operation of the tool of the invention in performing the method.
Figure 22:
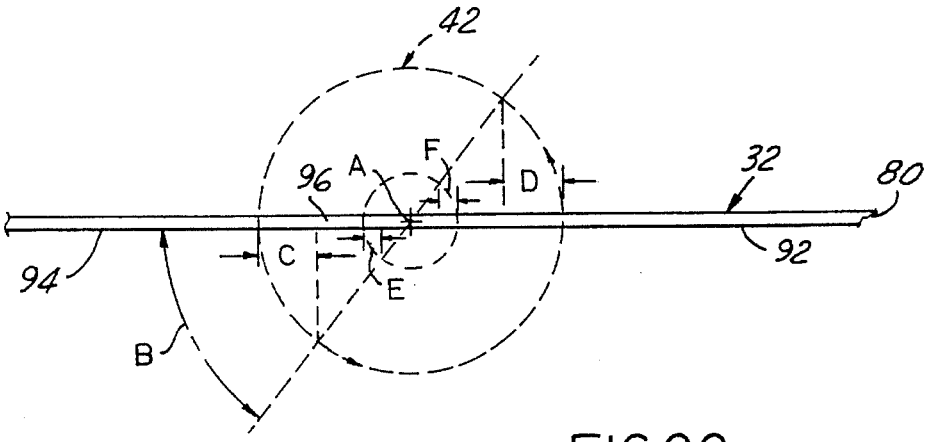
FIG. 22 is a fragmentary end elevational diagrammatic view of the diagrammatic layout of FIG. 21.

FIGS. 20, 21 and 22 illustrate semi-diagrammaticaly by comparative analysis further aspects of the foregoing method, and of the tool embodiments for performing the same, in the operation of severing tensioned strip material. Referring first to FIGS. 21 and 22, a longitudinally restrained band strip 32 is illustrated as engaged by the schematic showing of head 42 corresponding to the fully band-engaged position of tool 40 in FIGS. 3 and 5. It will be seen that the aforementioned head taper angle T in the plane of head slot 44 also defines the outer edge boundaries of the strip portion 96 held entrapped in slot 44. It will be further seen that as head 42 is rotated by handle 70 from the start position of FIGS. 3 and 5 toward to the mid-stroke position of FIG. 6, head 42 rotates about axis A concident with its centerline C/L. It is assumed in these diagrams that strip 32 is held substantially restrained at the opposite ends of the associated engaged run 80 thereof with the tool-engaged portion 96 of strip 32 spaced away from any associated bound package surface so as to be essentially to be disposed in "free air". It will also be assumed for this theoretical analysis that the material of strip run 80 is fully elastic and yieldably stressed only below its yield point.

Thus if head 42 is so rotated through a given angular increment indicated by the angle B in FIGS. 21 and 22, the free portions 92 and 94 of run 80 theoretically will be drawn toward one another by a uniformly varying distance transversely of strip run 80. More particularly, for rotation angle B the edge 90 of free run portions 92 and 94 will each be drawn closer together lengthwise of strip run 80 by the equal distances projected as C and D respectively in FIGS. 21 and 22. Distances C and D thus represent the theorectical strain increments imposed along edge 90 of strip run 80 by this increment of head rotation. Meanwhile, the opposite side edge 91 of free run portions 92 and 94 of strip run 80 likewise will also be drawn toward one another but, due to the taper angle T, by only much smaller distances of equal strain increments represented as E and F respectively in FIGS. 21 and 22. It will be seen that the theoretical total strain displacement of strip portions 92 and 94 during such head rotation will vary essentially uniformly as a trigonometric function of angle B of head rotation and of taper angle T, decreasing from a maximum at the blind inner of head slot 44 to a minimum at the mouth of slot 44 at the nose end 46 of head 42 (i.e., strain increment C+D versus strain increments E+F). The resultant stretching tensile forces imparted by such head rotation on strip run 80 by this gathering, semi-wrapping action create a corresponding tensile stress distribution of forces exerted lengthwise of strip run 80 which likewise varies from a maximum to a minimum from strip edge 90 transversely across to strip edge 91.

In actual practice, steel strip run 80 will first yield for such initial wrap-gathering by slack take-up around loop 32 until run 80 becomes essentially immobilized between run bends 82 and 84. Thereafter, a further small angular increment of head rotation will be allowed by the elastic "give" of the material in strip runs 90 and 92 as a function of the increasing tensile stresses so imposed by continued head rotation. However, once edge 90 can no longer elastically elongate because it has been stressed near or beyond its yield point (elastic limit), minute localized rupture will initiate. Thus, due to the combination effect of: (1) the maximum tearing force being extered at strip edge 90, (2) the bending stress imposed on strip portion 80 between portions 92 and 96 from head rotation through angle B lifting strip portion 92 upwardly, and (3) the further concentration of high unit stresses at the serrated engagement of the tooth formation at the engaged raising edge of surface 54 of head slot 44, a rupture and tearing shearing action is initiated at strip edge 90 at the bend junction between portions 92 and 96, thereby initiating the tear 100 as described previously in conjunction with FIG. 6.

Once the strip tear 100 is so initiated, it progresses rapidly as head 42 is further rotated past angle B toward the end-of-stroke position of FIG. 4. Although the initial theoretical stress distribution along the bend line between strip portions 92 and 96 decreases tranversely of the strip from strip edge 90 to edge 91 prior to initial rupture of strip run 80, as soon as tear 100 occurs, the total stress being imparted by rotation of head 42 to strip run 80 must then be transmitted through the remaining in-tact connecting material of the untorn portion of the strip run 80. Hence the magnitude of the stress distribution in this remaining untorn portion of the strip is thereby increased, thereby offsetting the decreasing strain displacement along the strip bend created by the head taper angle T progressively reducing the strain displacement toward the pointed end 46 of head 42. Hence the severing tensile forces generated by these conjoint motions and structure will remain high in the decreasing amount of untorn, load bearing strip material during tear propogation. Therefore strip run 80 will continue to be rapidly torn along the bend junction of portions 92 and 96 until the strip is completely severed during a relatively small angular increment of continued head rotation.

In the case of head 42 receiving support from the package bearing surface 39 during the strip severing action as shown in FIGS. 1–6, the junction of free strip portion 92 with trapped portion 96 is bent at a greater angle G (FIG. 5) then the bend angle H (FIG. 5) included between the other free strip portion 94 and trapped portion 96. Hence in this application the strip tear 100 initiates at the bend junction between strip portion 92 and trapped portion 96 (but always beginning at the rear of slot 44) rather than at the bend junction of strip portion 94 with trapped portion 96. However it is to be understood that the band severing tool head 42 of the invention, as well as the various modifications thereof shown in FIGS. 9–19, will operate equally well in severing band strip 32 when there is no bearing supporting surface 39 for head 42 in the aforementioned rotary severing action, i.e., during "free-air" operation.

For comparison testing, a test sample was constructed as shown in FIG. 20 in which a head 200 was provided having a cylindrical periphery 202 of uniform diameter throughout the axial length of the strip-receiving head slot 204. The diameter of comparison sample head 200 was essentially the same as the cylindrical surface 50 of a test head 42, the overall axial length of head 200 being essentially the same as that of the test head 42. Handles 70 of equal size and moment arm were affixed in the same manner and orientation, one to each of the sample head 200 and test head 42. When sample head 200 was strip-engaged to a position corresponding to that of head 42 in FIG. 3 and then rotated in the manner of head 42 between the full stroke end-limit positions of FIGS. 3 and 4, utilizing a test band strip 32 identical to that employed in testing head 42, strip run 80 was only partially severed, beginning at edge 90 and tearing only for a portion of the traverse distance across the test strip towards the edge 91 (i.e., about 50% of strip width). Hence it was found the test strip could not be severed in one swing stroke of tool 200. By comparison, test head 42 completely severed strip 32 after being rotated only through about half the swing stroke angle S of FIG. 4. Accordingly, it is believed that the head slot taper angle T utlized in the method and tool embodiments of the invention is an important feature contributing to the successful results obtained by the invention, and these test results are believed to at least partially verify the theorectical analysis of the operating principles set forth above in connection with FIGS. 21 and 22.

From the foregoing description it will now be apparent that further modifications of the foregoing embodiments may be provided without departing from the spirit and scope of the invention. For example, the invention is believed to be operable successfully with only one tooth formation provided at the bend junction of trapped strip portion 96 with free portion 92 (in the operating mode of FIG. 6). However, it is preferred to provide tooth formations along each of the four edges of head slot 44, both for manufacturing economy and to provide universiality (i.e., severing swing stroke in either direction of head rotation) in the operation and use of the severing tool of the invention. Moreover, providing at least two diagonally opposed strip-engaging tooth formations, at one each of the bend junctions of the strip, enhances head gripping action on the trapped portion 96 of strip run 80 to help concentrate maximum strain and hence maximum tearing stress more rapidly at edge 90 of strip run 80.

Although theoretically with "free-air" operation of tool 42, simultaneous strip tearing could occur along both opposite strip-engaged edges of head slot 44, commencing at the rear of the slot along the band-engaging diagonally opposite slot edges in actual practice one or other of the transverse edges of the trapped strip portion 96 will commence tearing first, beginning at the more highly stressed strip longitudinal edge 90. Once this tear is initiated, it will continue across the strip along the same side of head 42, while the other side remains untorn, because tearing forces are thereafter more concentrated along the remaining untorn portion of this strip slot edge being torn than in the other completely in-tact strip portion at the other slot edge. It will also be understood that taper included angle T can be varied in the construction of a given band severing head of the invention. However, in practice, angle T is preferably within the range of 35° to 45°, and is partially a function of the maximum overall length of the head versus its practical maximum diameter in use when applied as illustrated for breaking steel banding straps. Such banding straps in heavy duty packaging operations typically vary in width from 0.500 inches to 1.500 inches, and vary in thickness from 0.035 inches to 0.050 inches. Thus, for such applications, a successful working example of a tool 40 constructed in accordance with the invention as illustrated in FIGS. 1–6 and 11, utilized the following dimensional and constructional parameters:

| | |
|---|---|
| Axial length of head 42 | 2.125 inches |
| Diameter of rear shoulder surface 50 | 1.500 inches |
| Taper angle T | 40° |
| Axial length of slot 44 | 1.625 inches |
| Uniform gap dimension of slot 44 between parallel surfaces 52 and 54 | .100 inches |
| Pitch of thread 60 | .125 inches |
| Depth from peak to root of thread 60 | .060 inches |
| Moment arm of handle 70 from center line axis A of head 42 to center line of T bar handle 74 | 12 inches |
| Material of banding strip 32: | |
| Width dimension; | 1.500 inches |
| Thickness dimension; | .050 |
| Strip Material; | Commercial Strapping (Steel) |
| Angle of swing of handle 70 from upright position of FIG. 3 to completion of strip severing in the swing angle S of FIG. 4 | approximately 90° or less |

It will thus be seen that the method of the invention, and the tool of the invention provided for performing the method, provide many advantages over the prior commercially available banding strip cutting tools. In addition to the advantages set forth previously herein, it is to be noted that the presently preferred forms of the band severing tools of the invention have no internal relatively moving parts in their construction, other than in the socket wrench type applications of FIGS. 15–18. The rotatable cutting heads themselves are preferably constructed unitarily as a one-piece part and hence are economical in construction and reliable, durable and safe in use. In addition to an inherently long service life from this feature, the various tooth forms provided along the edges of the band receiving slot 44 etc. of the cutting head have been found to be variable over a wide range of configurations without impairing the band severing action of the tool. However, in practice the rounded type tooth form 60 illustrated in FIG. 11, whether made in a helical thread or parallel groove turning operation, or made in a grinding or milling operation as in the embodiments of FIGS. 13 and 14, is generally preferred because of the durability of this type of configuration in use of the tool. It also has been found that the degree of sharpness of the teeth along the head slot edges is a relatively non-critical parameter and hence no sharpening operation is needed either in the manufacture of the head nor during its continued service life. The slot edge teeth 62–64, 60', 60', 118–120 and 174 have been found to operate successfully with a zero degree rake angle, i.e., the face of each tooth lying flush with and parallel to the plane of the associated slot faces 52 and 54 of head slot 44. Hence machining of head slot 44 and the faces of the slot edge teeth can and preferably does occur in one and the same operation with same machine tool.

It also is to be understood that the rotary cutting heads 42, 42', 42", 110, 122, 142 and 162 of the various disclosed embodiments also lend themselves to economical manufacture by lost wax or other sand casting or permanent molding processes in which all of the constructural features of the head are imparted in the casting operation and no further finishing is needed. Preferably during such casting operation the cast material utilized is S-7 or D-2 tool steel material. The fact that the slot edge teeth may be essentially dull, both initially and in use, also lends itself to this cast-in-final form feature as well as enhancing the safety of the tools of the invention in handling and use.

In addition, the characteristic bent up trapped portion 96 of strip run 80 remaining after completion of band severing, as illustrated in FIG. 7, also enhances worker safety, particularly in the case of steel banding which may have relatively sharp longitudinal side edges and/or burrs therealong. This bent up strip portion 96 provides a convenient finger grip tab for more easily handling a severed band loop when the same is being removed from the associated package and discarded to a scrap bin. In this regard, the essentially dull nature of the severed edges 102 and 104 formed in steel banding material by the band severing method and tool of the invention does not pose any greater handling hazard than a sharp scrissors-cut edge, and more often is safer to handle.

It is also to be understood that the angle of the plane of the band receiving slot 44 may be varied relative to the attachment angle of the axis of rod 72 of the fixed handle 70, as exemplified by the alternate "socket-wrench type" embodiments of FIGS. 15–18. These embodiments in turn may be operated by other types of standard wrenches, such as open end wrenches or box wrenches if desired. Moreover, the rotational axis of heads 42, etc. In operation may be offset and/or inclined relative to the rotational center line axis C/L of the head rotator, as indicated by head 162 of tool 160. It is also possible to reverse the taper angle T relative to the rotator end the head of the tool, i.e., such that the head slot is wider at its mouth than at its blind end in the head. However, the orientation of taper angle T as set forth in the illustrated embodiments is presently believed to represent the best mode of making and using the apparatus and method of the invention.

It has also been found that tool 160 can be used to sever steel wire stock having a diameter of up to almost 0.080 inches wherein the wire was held in tension in the severing zone. In one test a length of such wire (having a diameter of about 0.070–0.072 inches) was wrapped around a coil of steel and its ends twisted together to place the wire under tension taut about the coil. Tool 160 was used in the manner described previously herein, the wire being inserted about midway into and extending across slot 44, and handle 70 then rotated through about a 90° swing, which thereupon severed the wire during this single swing stroke. Hence the term "band" as used herein is intended to encompass in its broadest sense analogous forms of strip material to be severed, including such round or other circular-type cross sectional material such as metal wire or their rod stock suitably held in tension at least in the severing zone.

It is to be further understood that, although the foregoing description and drawings describe and illustrate in detail various preferred embodiments of the invention, to those skilled in the art to which the present invention relates the present disclosure will suggest many modifications and constructions as well as widely differing embodiments and applications without thereby departing from the spirit and scope of the invention. The present invention, therefore, is intended to be limited only by the scope of the appended claims and the applicable prior art.

I claim:

1. A method of severing an elongate strip of banding material comprising the steps of:

(a) holding a given run of the banding strip at two spaced apart locations longitudinally of the band run so as to resist foreshortening of the banding material of the held run between said holding locations;

(b) positioning a pair of band engaging members at a location along the held run between the holding locations;

(c) orienting the band engaging members one adjacent each opposite lateral face of said band run with said members extending transversely of the longitudinal dimension of the held run such that each band engaging member extends entirely across the transverse dimension of the run;

(d) further orienting the band engaging members convergently relative to one another transversely of the band strip run;

(e) bodily moving said band engaging members conjointly in a rotational path about a common axis of revolution and in the same rotational direction so as to thereby engage and angularly displace an engaged portion of the held run disposed between said members and impart a partial wrapping to the run engaged portion relative to non-engaged portions of the band run extending longitudinally away from the engaged portion of the held run, thereby tending to foreshorten the held run longitudinally thereof to thereby induce an increasing and variable tensile stress distribution along the respective lines of engagement of the band engaging members with the held run during such rotational bodily movement thereof;

(f) further continuing such rotary bodily motion of the band engaging members to cause the material of the held run along the most highly stressed longitudinal edge thereof to rupture to thereby initiate a tearing action transversely of the held run along at least one of the band engaging members;

(g) then continuing such rotational bodily motion of the band engaging members sufficient to complete tearing of the held run across the band engagement line of such one band member to thereby completely sever the held run of the strip band;

(h) then ceasing such rotary bodily motion of the band engaging members and disengaging the severed band run therefrom;

and wherein step (b) further comprises the steps of:

(i) providing said at least one band engaging member in the form of a solid body of metal having a band engaging edge defined by a first surface adapted to lay flat against the engaged held run in steps (c) through (g) and a second external surface intersecting said first surface generally at an angle perpendicular thereto along the line of engagement of said one band member with the held run, and (j) forming a plurality of band run engaging teeth arranged in a serrated tooth pattern along said band engaging edge wherein the face of the teeth forming said tooth pattern are disposed flush with said first surface by creating a pattern of grooves and ridges extending parallel to one another on said second surface of said body of said at least one band engaging member and interrupted by intersection with said first surface at said band engaging edge to thereby form a row of said teeth therealong.

2. A band severing tool comprising:

a band severing tool head comprising a body rotatable about an operational axis and having a major longitudinal axis extending between first and second longitudinally spaced apart ends of said body in the direction of the operational rotation axis of said, said body having a rotator means constructed and arranged at said first body end for applying a rotational torque to said body about a moment arm centered on said body longitudinal axis to impart bodily rotation to said body about its operational rotation axis, said body having an exterior peripheral surface disposed between said body ends, said body also having a passageway in the form of a continuous slot extending laterally therethrough between said first and second body ends and in a plane oriented generally parallel to said body longitudinal and operational axes, said passageway slot having first and second open ends disposed in said body exterior peripheral surface laterally opposite one another relative to said body operational rotation axis, said passageway slot having a pair of opposed surfaces defining a slot gap therebetween constructed and arranged to receive therethrough via said open ends thereof a run of a band of strip material with the run extending lengthwise through said passageway slot between said open ends with its length and width dimensions disposed generally parallel to said passageway plane and also with the band run extending lengthwise exteriorly of said body from both of said passageway open ends, said body exterior peripheral surface being interrupted by intersection therewith of said opposed slot surfaces at said passageway open ends to form first and second band engaging passageway edges on said peripheral surface extending respectively one along each said first and second open ends of body passageway and disposed diagonally opposite one another in said passageway, said passageway edges being constructed and arranged to impart a band severing rupture in the band run at the engagement thereof along one of said passageway edges transversely of the length dimension of the band in response to application of torque to said tool head via said rotator means thereof operable to cause said bodily rotation to said body in one continuous direction of rotation with the band run held engaged therewith with a portion of the run trapped in said body passageway slot, whereby a partial body-entwined wrapping action is applied to the band run by such bodily rotation of said tool head while said band is held exteriorly of said tool head to resist the tension stresses imparted to the band by such partial wrapping action to thereby cause complete rupture of the band run during such continuous unidirectional bodily rotation in less than one revolution thereof, wherein said external peripheral surface of said first and second band engaging edges of said body passageway are angularly oriented so as to extend at an angle relative to one another of less than 90° so as to taper convergently relative to one another in the direction of said major longitudinal axis of said body toward said second body end, wherein at least one of said passageway slot band engaging edges is provided with a plurality of band run engaging teeth arranged in a serrated tooth pattern along said one edge, and wherein said serrated tooth pattern is made up of a pattern of grooves and ridges extending parallel to one another on said peripheral surface of said body and interrupted by intersection with said slot surfaces to thereby form a row of said teeth at least along each of said first and second band engaging edges at said one passageway open end.

3. The tool as set forth in claim 2 wherein said tool head body is made entirely in one piece from a unitary high strength body of metal.

4. The tool as set forth in claim 3 wherein said unitary body is defined by said exterior peripheral surface and said slot also has an end opening at said second axial end of said body communicating with said laterally opposite open ends of said passageway whereby said tool body can be receivingly engaged with the band run by entry of the band run edgewise through said end opening of the slot at said second end of said body.

5. The tool as set forth in claim 2 wherein said tool further includes a handle means operable coupled to said rotator means of said body and having arm means extending generally perpendicularly from said body operational rotation axis and being constructed and arranged for application a force-multiplying moment arm for imparting via said rotator means the bodily operational rotation to said tool body.

6. The tool as set forth in claim 5 wherein said handle arm means comprises a handle rod having one end permanently affixed to said rotator means of said body and a tool manipulating operating end spaced remote from said one fixed end along said moment arm.

7. The tool as set forth in claim 5 wherein said rotator means of said body comprises a lug protruding axially away from said body and having polygonal surface means adapted for removable coupling to a polygonal driving face of standard wrench means, and said handle means comprises a standard wrench handle of said wrench means having driver means coupled thereto and providing said polygonal driving faces adapted for releasable engagement with said surface means on said tool head body lug for imparting said rotary operation motion to said tool body.

8. The tool as set forth in claim 2 wherein said body comprises a wedge shape member having first and second generally parallel surfaces defining respectively the top and bottom surfaces of said body, said body having a pair of side surfaces disposed respectively in planes transverse to the planes of said top and bottom surfaces and being convergent towards one another in direction of said second end of said body, said first and second passageway open ends being located one in each of said side surfaces.

9. The tool as set forth in claim 2 wherein said taper angle ranges between about 35° and 45°.

10. The tool as set forth in claim 2 wherein said slot is defined by a pair of opposed flat parallel surfaces defining a uniform slot gap therebetween having a gap dimension perpendicular to said slot surfaces slightly greater than the thickness of the run of band of material, said slot surfaces intersecting said outer peripheral surface of said body, and wherein the face of the teeth forming said tooth pattern are disposed flush with the plane of one of said slot surfaces.

11. The tool as set forth in claim 10 wherein said tool body peripheral surface comprises a surface of revolution encircling the said longitudinal axis of said body and concentric therewith, and wherein each of said passageway open ends defines a pair of said first and second band engaging edges in said peripheral surface, and said tooth serrations are provided by alternating grooves and ridges in said peripheral surface said body.

12. The tool as set forth in claim 11 wherein said unitary head body comprises a one piece casting made from tool steel and cast in finished form.

13. The tool as set forth in claim 11 wherein said serrated tooth pattern is formed by slots in said peripheral surface extending transversely to said pairs of passageway slot open edges and each having a root surface disposed chordally in said peripheral surface intersected by said slot open edges.

14. The tool as set forth in claim 11 wherein said serrated tooth pattern is formed by a helical thread lathe-turned in said peripheral surface coextensive longitudinally of said tool head with said slot pen ends and encircling the same to form said alternating grooves and ridges interrupted at said passageway slot open ends.

15. The tool as set forth in claim 14 wherein said thread is a round-type form of thread.

16. The tool as set forth in claim 15 wherein a flat chordal surface is formed transversely across said grooves and ridges of said tool head body and oriented between said slot open ends to enhance slidability of said tool head between the band run and a tool supporting surface.

17. The tool as set forth in claim 16 and adapted for rupture severing of steel banding straps ranging in width from about 0.500 to 1.500 inches and in thickness from about 0.035 to 0.050 inches, said tool body comprising a one piece unitary metal body with a cross slot defining said passageway therethrough open continuously at the sides and at said second axially end of the body, said slot having spaced parallel surfaces adapted to slidably receive said steel banding strap therein, said surfaces having a maximum spacing distance of about 0.100 inches, said body having a taper angle ranging between about 35° and 45° and said slot having a depth from said second axial end to a rear wall defining a blind end of a slot in said body of about 1.625 inches.

18. The tool as set forth in claim 10 wherein said tool body peripheral surface defines a conical shape convergent toward said second axial end of said body and oriented with the cone angle of said peripheral surface at said convergent taper angle.

19. The tool as set forth in claim 18 and adapted for rupture severing of steel banding straps ranging in width from about 0.500 to 1.500 inches and in thickness from about 0.035 to 0.050 inches, said tool body comprising a one piece unitary metal body with a cross slot defining said passageway therethrough open continuously at the sides and at said second axially end of the body, said slot having spaced parallel surfaces adapted to slidably receive said steel banding strap therein, said surfaces having a maximum spacing distance of about 0.100 inches, said body having a taper angle ranging between about 35° and 45° and said slot having a depth from said second axial end to a rear wall defining a blind end of a slot in said body of about 1.625 inches.

20. The tool as set forth in claim 18 wherein said tool further includes a handle means operable coupled to said rotator means of said body and having arm means extending generally perpendicularly from said body operational rotation axis and being constructed and arranged for application a force-multiplying moment arm for imparting via said rotator means the bodily operational rotation to said tool body.

21. The tool as set forth in claim 20 wherein said handle arm means comprises a handle rod having one end permanently affixed to said rotator means of said body and a tool manipulating operating end spaced remote from said one fixed end along said moment arm.

22. The tool as set forth in claim 20 wherein said rotator means of said body comprises a lug protruding axially away from said body and having polygonal surface means adapted for removable coupling to a polygonal driving face of standard wrench means, and said handle means comprises a standard wrench handle of said wrench means having driver means coupled thereto and providing said polygonal driving faces adapted for releasable engagement with said surface means on said tool head body lug for imparting said rotary operation motion to said tool body.

* * * * *